US005967809A

United States Patent [19]

Fink et al.

[11] Patent Number: 5,967,809

[45] Date of Patent: Oct. 19, 1999

[54] ELECTRICAL CONNECTOR

[75] Inventors: Randy Lynn Fink; Brian Matthew Donato, both of Warren; Michael Patrick Cummings, Canfield, all of Ohio

[73] Assignee: General Motors Corporation, Detroit, Mich.

[21] Appl. No.: 09/144,601

[22] Filed: Jan. 20, 1998

Related U.S. Application Data

[63] Continuation-in-part of application No. 08/716,958, Sep. 23, 1996, Pat. No. 5,775,957.

[51] Int. Cl.[6] ..... H01R 13/62

[52] U.S. Cl. ..... 439/157

[58] Field of Search ..... 439/157, 347, 439/310

[56] References Cited

U.S. PATENT DOCUMENTS

| | | | |
|---|---|---|---|
| 4,894,017 | 1/1990 | Stein et al. | 439/595 |
| 4,946,402 | 8/1990 | Fink et al. | 439/274 |
| 4,963,103 | 10/1990 | Fink et al. | 439/352 |
| 5,189,788 | 3/1993 | Sakai et al. | 29/842 |
| 5,252,092 | 10/1993 | Reider et al. | 439/595 |
| 5,326,274 | 7/1994 | Pfaff et al. | 439/157 |
| 5,350,313 | 9/1994 | Woller | 439/157 |
| 5,496,184 | 3/1996 | Garrett et al. | 439/595 |
| 5,545,053 | 8/1996 | Ishii et al. | 439/701 |
| 5,564,953 | 10/1996 | Endo et al. | 439/701 |
| 5,591,052 | 1/1997 | Watanabe | 439/752 |
| 5,618,194 | 4/1997 | Maue et al. | 439/157 |
| 5,637,009 | 6/1997 | Tsuji et al. | 439/347 |
| 5,672,067 | 9/1997 | Ryll et al. | 439/157 |
| 5,681,184 | 10/1997 | Pamart et al. | 439/347 |

*Primary Examiner*—Gary Paumen
*Attorney, Agent, or Firm*—Anthony L. Simon; Patrick M. Griffin

[57] ABSTRACT

An electrical connector comprising: a housing assembly (328, 318) having at least one slot (562) extending substantially therethrough; a releasable positive stop (636, 638) on the housing assembly; at least one lock (632) on the housing assembly; a slide assembly (312 and 314) slidably received within the at least one slot; and at least one locking wall (650) on the slide assembly, wherein, in initial engagement of the slide assembly to the housing assembly where the slide assembly is slid into the at least one slot in an engagement direction, the positive stop prevents movement of the slide assembly beyond a prestage state, wherein, in the prestage state, the lock engages the locking wall preventing disengagement of the slide assembly from the prestage state. Thus, an advantageous prestage state of the electrical connector is achieved. When the positive stop is released and a mating connector is aligned with the electrical connector, force applied to the slide assembly in the engagement direction moves the slide assembly past the prestage state to fully engage the housing assembly and to force the mating connector into full engagement with the electrical connector.

8 Claims, 8 Drawing Sheets

ELECTRICAL CONNECTOR

This is a CIP of Ser. No. 08/716,958, filed Sep. 23, 11996, now U.S. Pat. No. 5,775,957 issued Jul. 7, 1998.

The invention relates to an electrical connector.

BACKGROUND OF THE INVENTION

Electrical connector systems are known for use in automotive vehicles to facilitating removable connection of electrical harnesses.

SUMMARY OF THE PRESENT INVENTION

It is an object of this invention to provide an electrical connector.

Advantageously, this invention provides an electrical connector suitable for implementation as a high-power, multi-row connector.

Advantageously, this invention provides an electrical connector that houses a series of female terminals. The electrical connector is adapted to receive a mating male connector and includes the use of a slide assembly comprising a slide and a slide assist. The slide includes a series of slots that operate on a set of tabs on the male connector. When the tabs on the male connector are aligned within the slots on the slide, an operator forces the slide assembly in an engagement direction and the slots act as cams on the tabs, which act as cam followers, drawing the male connector into engagement with the electrical connector housing the female terminals.

Advantageously, the electrical connector has a prestage state of the slide assembly with respect to the housing assembly, allowing the slide assembly to be pre-assembled to the housing assembly. The prestage state appropriately aligns the slots on the slide to receive the tabs on the male connector. Because the slide assembly is secured in the prestage state, the mating to the male connector may occur immediately after assembly of the slide assembly to the housing assembly or after further shipment of the connector to another location, whichever is desired by the assembler using the electrical connector.

Advantageously then, according to a preferred example, this invention provides an electrical connector comprising: a housing assembly having at least one first slot extending substantially therethrough; a releasable positive stop on the housing assembly; at least one lock on the housing assembly; a slide assembly slidably received within the at least one first slot; and at least one locking wall on the slide assembly, wherein, in initial engagement of the slide assembly to the housing assembly where the slide assembly is slid into the at least one first slot in an engagement direction, the positive stop prevents movement of the slide assembly beyond a prestage state, wherein, in the prestage state, the lock engages the locking wall preventing disengagement of the slide assembly from the prestage state, wherein, when the positive stop is released and a mating connector is aligned with the electrical connector, force applied to the slide assembly in the engagement direction moves the slide assembly past the prestage state to fully engage the housing assembly and to force the mating connector into full engagement with the electrical connector.

BRIEF DESCRIPTION OF THE DRAWINGS

The present invention will now be described by way of example with reference to the following drawings in which.

DETAILED DESCRIPTION OF THE INVENTION

Figure 1:
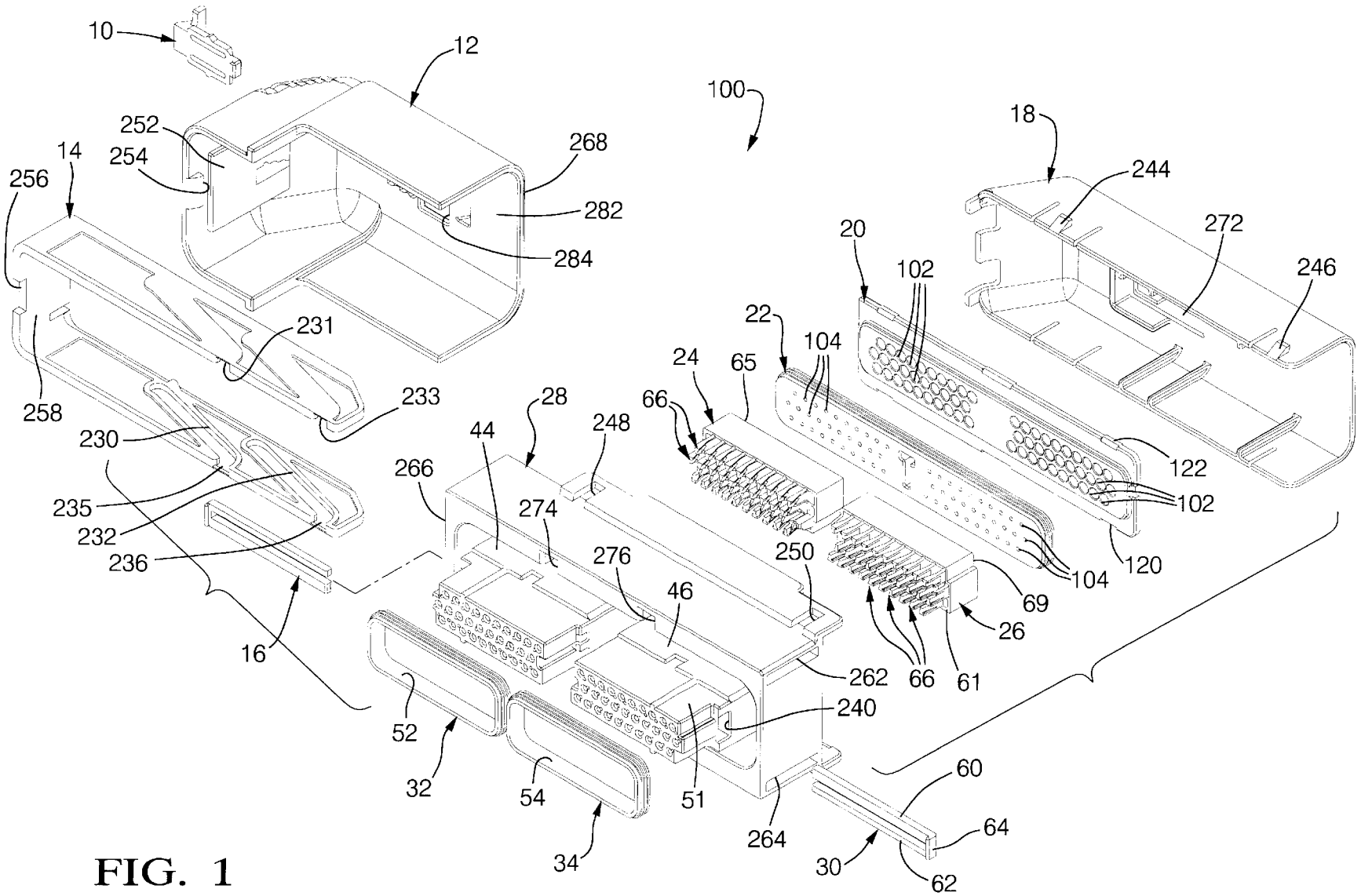
FIG. 1 illustrates an exploded view of an example female electrical connector according to this invention.
Figure 2:
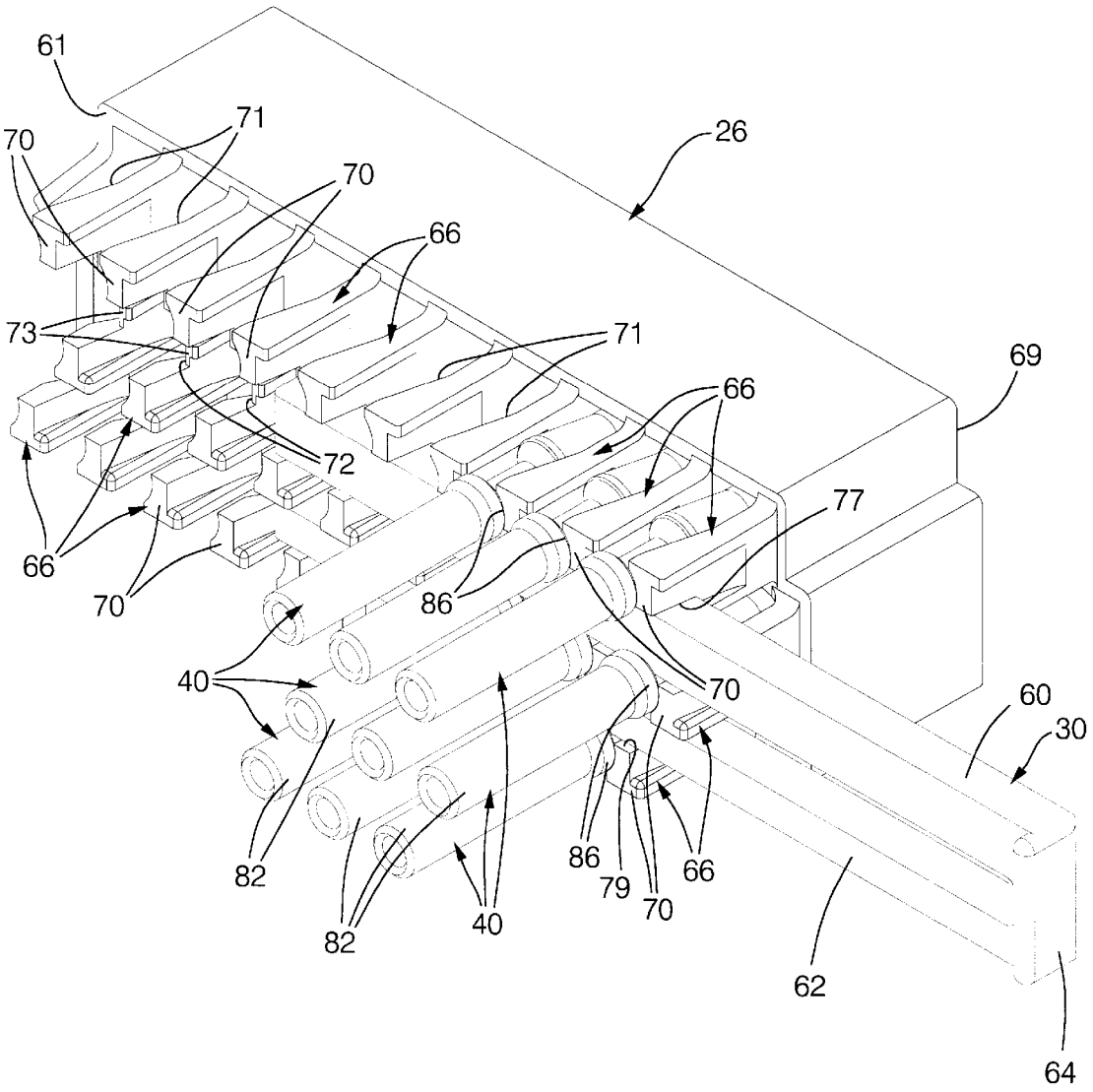
FIG. 2 illustrates operation of an example secondary lock feature according to this invention.

Referring now to FIGS. 1–4, the example female electrical connector 100 shown comprises outer housing 28, inner housings 24 and 26, cable seal 22, strain relief plate 20, wire dress cover 18, comb locks 16 and 30, connector seals 32 and 34, slide 14, slide assist 12 and connector position assurance component (CPA) 10.

The inner housings 24 and 26 each contain a plurality of flex arms (flexible extensions) 66 aligned with the plurality of cylindrical openings 67. Each flex arm 66 has an end surface 70 at the end of the flex arm 66 and a ramp 71 on the flex arm. Using inner housing 26 as an example, the terminals 40 are inserted into the openings 67 in the inner housing 24 from side 69 of the inner housing 24. The terminals are pushed through the openings 67 until they project out of the other side 61 of the housing between the various flex arms 66. Each terminal pushes on the ramp 71 on the flex arm 66, which flexes in a cantilever motion and then snaps in place behind shoulder 86 of the terminal 40 so that shoulder 86 seats on the seat surface 70, maintaining the terminal 40 in place.

Figure 3:
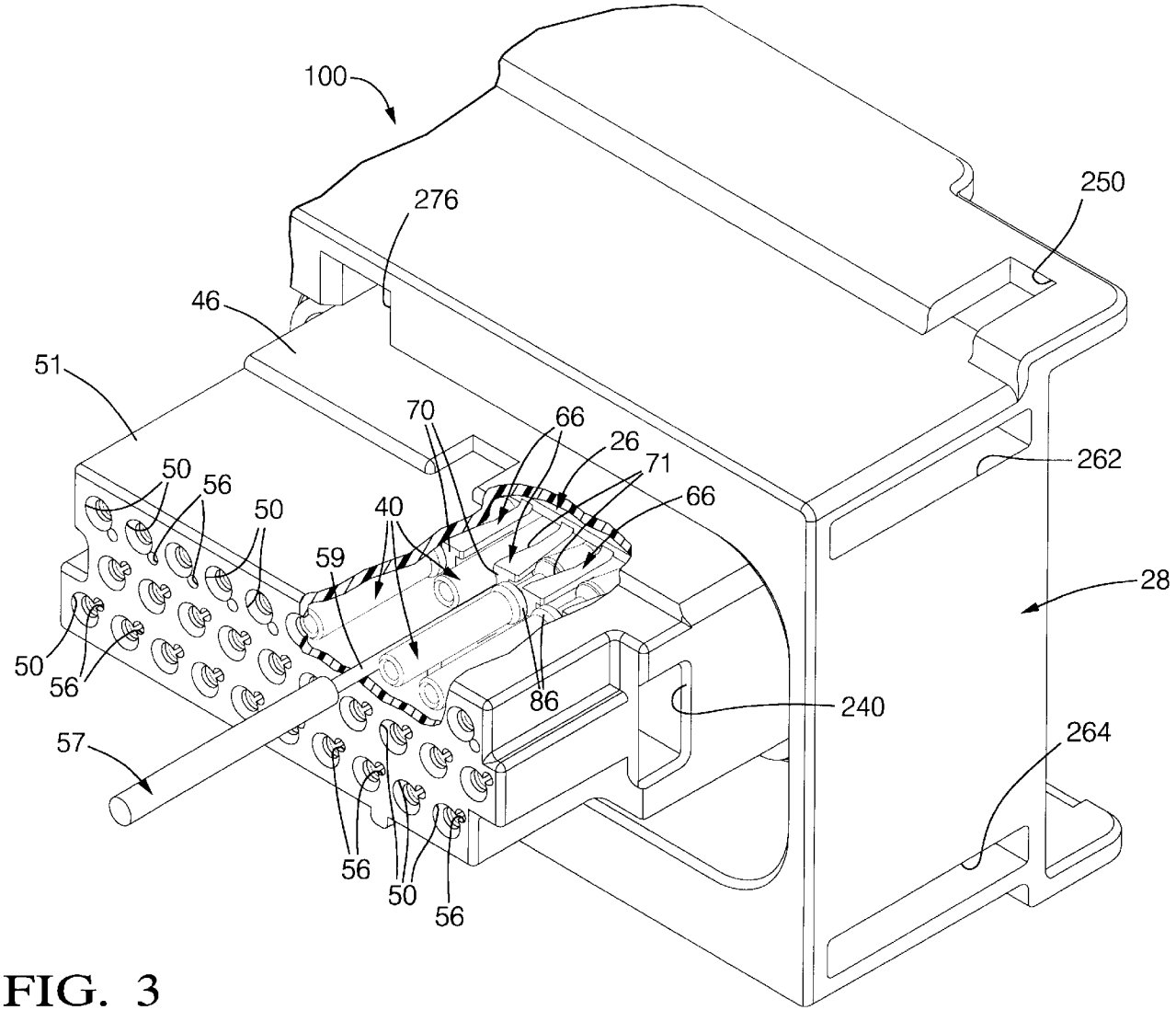
FIG. 3 illustrates an example feature allowing for removal of the electrical terminals from the electrical connector.
Figure 7:
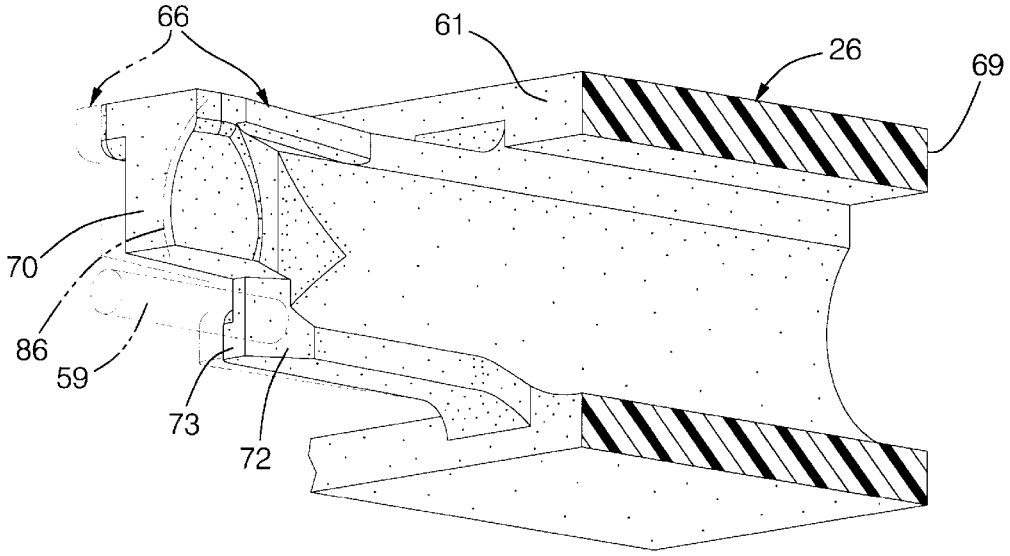
FIG. 7 illustrates an example flex arm of an inner housing for uses with this invention.

Referring now also to FIG. 7, each flex arm 66 also includes a ramp 72 associated therewith, located between the ends of the flex arm 66. Each ramp 72 has a top surface 73 extending laterally from the flex arm 66 at a point between the ends of the flex arm 66, providing a seat to the lock bars 60, 62, as described below. Each ramp 72 is positioned so that when the inner housing is assembled into the outer housing 28, each ramp 72 is aligned with one of the access holes 56 (FIG. 3). The access holes 56 allow access of a small tool 57, for example, having a 0.8 mm round rod 59, to extend through the access hole 56 and deflect the flex arm 66 through cam action with the ramp 72, allowing seat surface 70 to disengage from the shoulder 86 of the terminal 40 and allowing removal of the terminal 40 from the inner and outer housings 26 and 28, i.e., from the end 69 of the inner housing 26.

After the terminals 40 are inserted in the inner housing 26, the housing is inserted into the cavity 36 of outer housing 28 causing terminal ends 82 to extend into the cylindrical cavities 84 of the terminal position portion 51 of outer housing 28. Each cavity 84 has an inner seat 80 preventing the terminal end 82 from extending out of the opening 50 of outer housing 28.

After the inner housing 26 is inserted in the outer housing 28, cable seal 22 is inserted in place abutting the inner housings 24 and 26, i.e., adjacent end surfaces 69 and 65 of inner housings 26 and 24. The cable seal 22 has a plurality of openings 104 through which the terminals 40 extend. The cable seal 22 is maintained in place by strain relief plate 20, also containing a series of openings 102 through which the terminals 40 extend. The strain relief plate is snapped in place by a plurality of cantilever arms 108 and 110 having locking seats 112 and 114 on the ends 116 and 118 thereof locking against seats 120 and 122 of the strain relief plate 20.

The cable seal 22 is constructed of a resilient material such as an elastomer or rubberized foam and provides a spring force against the end 69 of the inner housing 26 and the similar end 65 of housing 24. Because the inner housing is separate from the outer housing 28 and is maintained in place by resilient member 22, there is some free play allowed in position of the inner housing 26 within outer housing 28.

Comb locks 16 and 30 both operate in the same way to lock the inner housing within the outer housing and ensure that the terminals 40 are appropriately positioned and locked in place. Using comb lock 30 as an example, comb lock 30 has a closed end 64 and two extending locking bars 60 and 62 projecting from the closed end 64 so that the comb lock 30 has a generally elongated U-shape.

The flex arms 66 on the inner housing 26 are arranged in spaced-apart rows that form channels 77, 79 for the lock bars 60 and 62 on the comb lock 30. Likewise, the terminals 40, when positioned in inner housing 26, are aligned in the same three rows as the flex arms 66. Each row comprises, alternately placed flex arms 66 and terminals 40. When the inner housing 26 is placed within the outer housing 28 and the terminals 40 are in place, the comb lock 30 is slid through opening 240 in the outer housing and the lock bars 60 and 62 slide down the channels 77, 79, riding along the top surfaces 73 of the ramps 72 of the flex arms 66. Once in the channels, the lock bar aids retention of each terminal 40 in place by providing a locking surface for seat 86 on the terminal 40, preventing terminal 40 from being removed and by engaging with the opening 240 of the outer housing preventing the inner housing from being removed from the outer housing 28.

The resilient cable seal 22 is under some compression due to the strain relief plate 20 being snapped in place into housing 28. This provides spring force against the ends 65, 69 of the inner housings 24, 26 pressing inner housings 24, 26 toward the positioning end 51 of the housing 28 and providing friction lock of the lock bars 60 and 62 in place between the surfaces 73 and the inner end wall 242 of the cavity 36.

Figure 4:
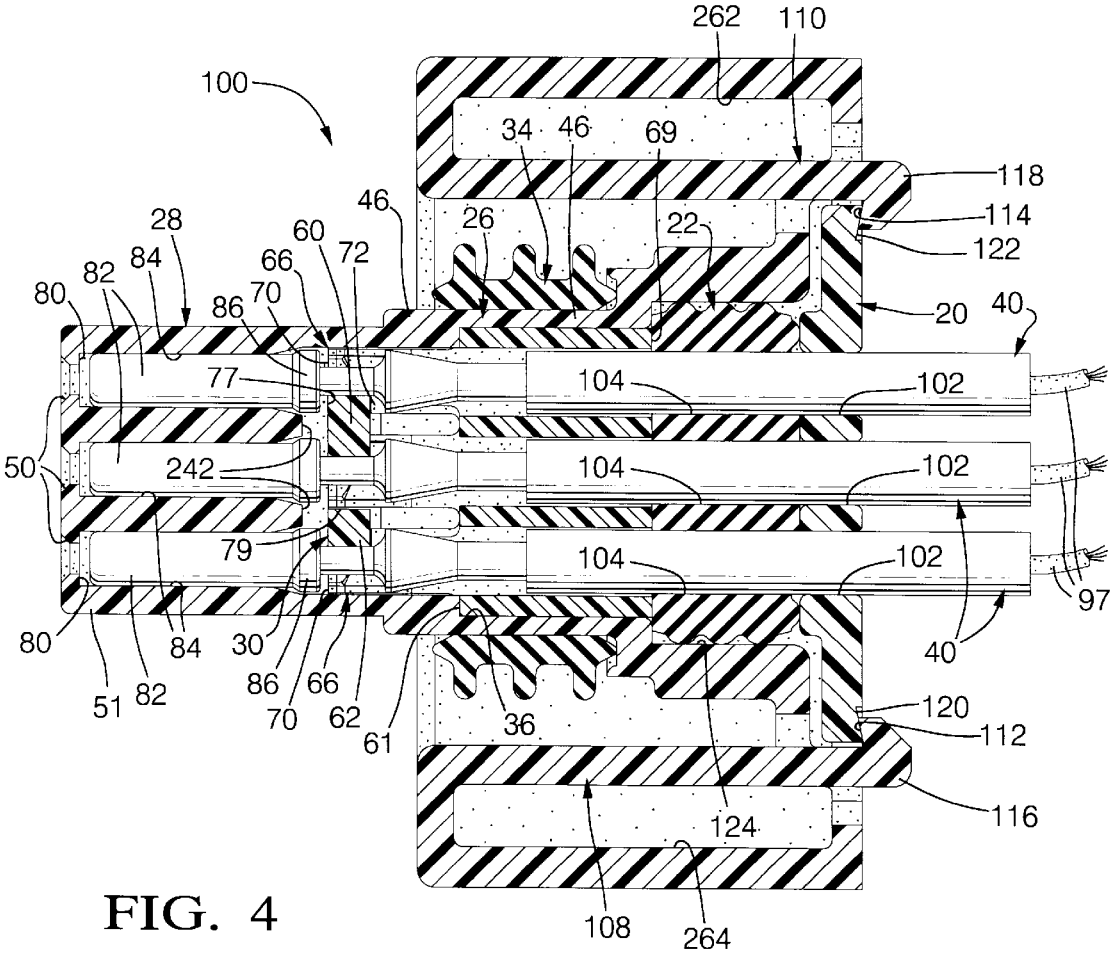
FIG. 4 illustrates a section view of an example electrical connector according to this invention.

As illustrated in FIG. 4, each terminal 40 has an electrical wire 97 connected thereto in a known manner, for example, through crimping, and the wires 97 generally comprise part of one or more harnesses in an electrical system, for example, for a motor vehicle. The dress cover 18 snaps in place to outer housing 28 with ramp and locks 244 and 246 engaging slots 248 and 250 on the outer housing.

Connector seals 32 and 34 of a known type have inner seal surfaces 52 and 54 that fit snugly on outer surfaces 44 and 46 of the connection end of outer housing 28. The outer surfaces of the seals 32, 34 engage inner surfaces 290, 292 of the shroud 202 (FIG. 5) of the male terminal 200.

Figure 5:
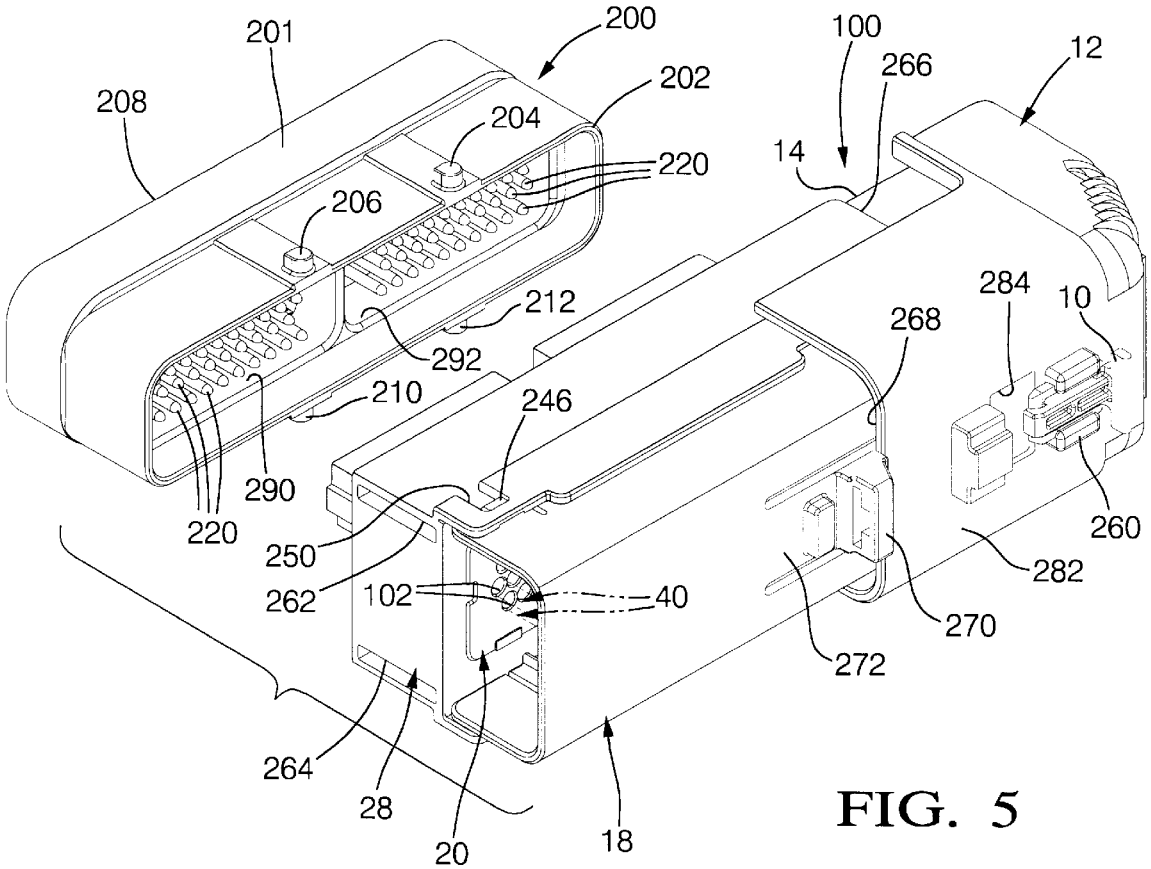
FIGS. 5 and 6 illustrate example engagement of male and female electrical connectors according to this invention.
Figure 6:
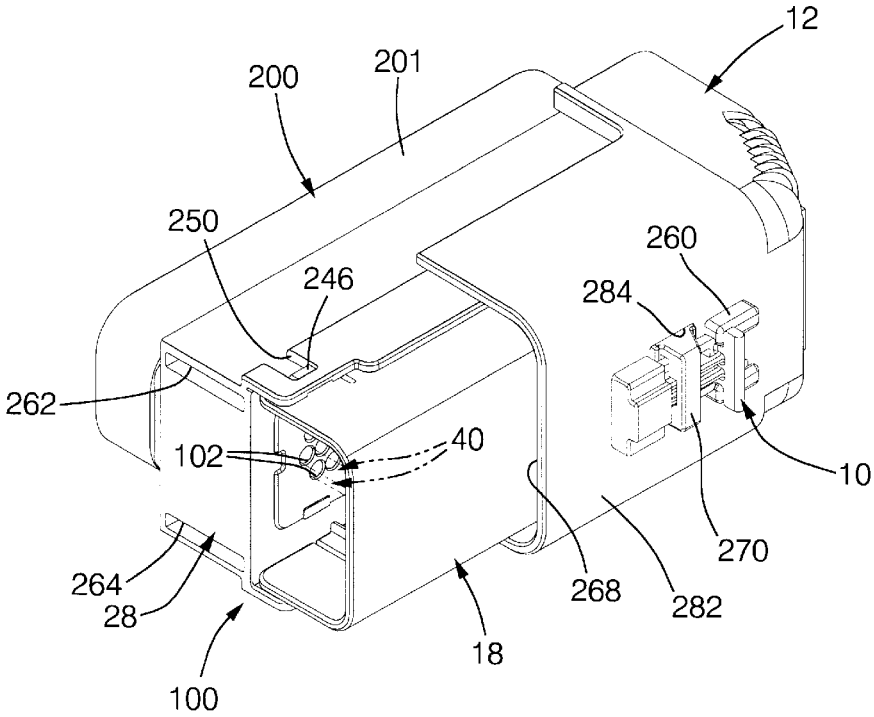

Referring now to FIGS. 5 and 6, the engagement of the female connector 100 with male connector 200 is illustrated. The male connector 200 generally has a structure of a known type and includes housing 201 with extending shroud 202. Extending out of the extending shroud 202 are four buttons 204, 206, 210, 212 for locking with the female connector 100. Within the shroud 201 are a plurality of male terminals 220 for engaging the female terminals 40 of the female connector 100 in a known manner. A plurality of cable wires (not shown) are connected to the male terminals 220 and extend out the male connector 200 in a known manner.

To mate the connectors 100 and 200, the slide 14 is first snapped into position into slide assist 12 with tab 252 engaging end 258 of the slide so that notch 256 is seated behind lock 254 of the slide assist 12. The CPA 10 is also snapped in place in intermediate holder 260 molded on the exterior of slide assist 12. With the slide 14, CPA 10 and the slide assist 12 so assembled, the slide 14 is inserted into the slots 262 and 264 in the outer housing 28 from the end 266 thereof and slid in place until the front surface 268 of slide assist 12 bumps against the front of the CPA lock feature 270, located on cantilever finger 272 on the top of wire shroud 18. In this position, the male connector is ready to be assembled to the female connector and the slot inlets 231, 233, 235 and 236 are aligned with the slots 274, 276 and two other slots not shown of the outer housing 28.

The male connector 200 is then aligned so that the tabs 204, 206, 210 and 212 enter the slots 274, 276 and the two slots not shown beginning engagement of the male terminals 220 to the female terminals 40. Force is then applied on the slide assist 12 to slide the slide 14 more into the outer housing 28. Deflection of cantilever arm 272 is necessary to allow surface 268 past feature 270 of the wire shroud 18. Through the resulting motion, the inner slot ramps 230, 232 (only two shown) act on the tabs 204, 206, 210, 212 of the male connector 200 forcing the connector into full engagement with the female connector and mating the male/female connectors 200 and 100 together.

During this process, the lock feature 270 is forced underneath the side 282 of the slide assist 12 through cantilever action of finger 272. The male/female connectors 200 and 100 are not fully engaged until the CPA lock feature 270 pops into position in opening 284 in slide assist 12. Once in this position, the CPA 10 can be slid forward from its engagement position in the retainer 260 to a snap-lock position in feature 270. If CPA 10 cannot slide forward and snap into the snap-lock position in feature 270, then the terminal is not completely engaged. Once the terminals are completely engaged and the CPA lock is slid into position, the terminals are locked in place and cannot be disengaged until the CPA 10 is removed.

The housings 24, 26 and 28, the strain relief plate 20, the wire dress cover 18, the slide 14, the slide assist 12, the comb locks 16 and 30 and the CPA 10 can all be molded out of plastic, vinyl or other suitable material.

Figure 8:
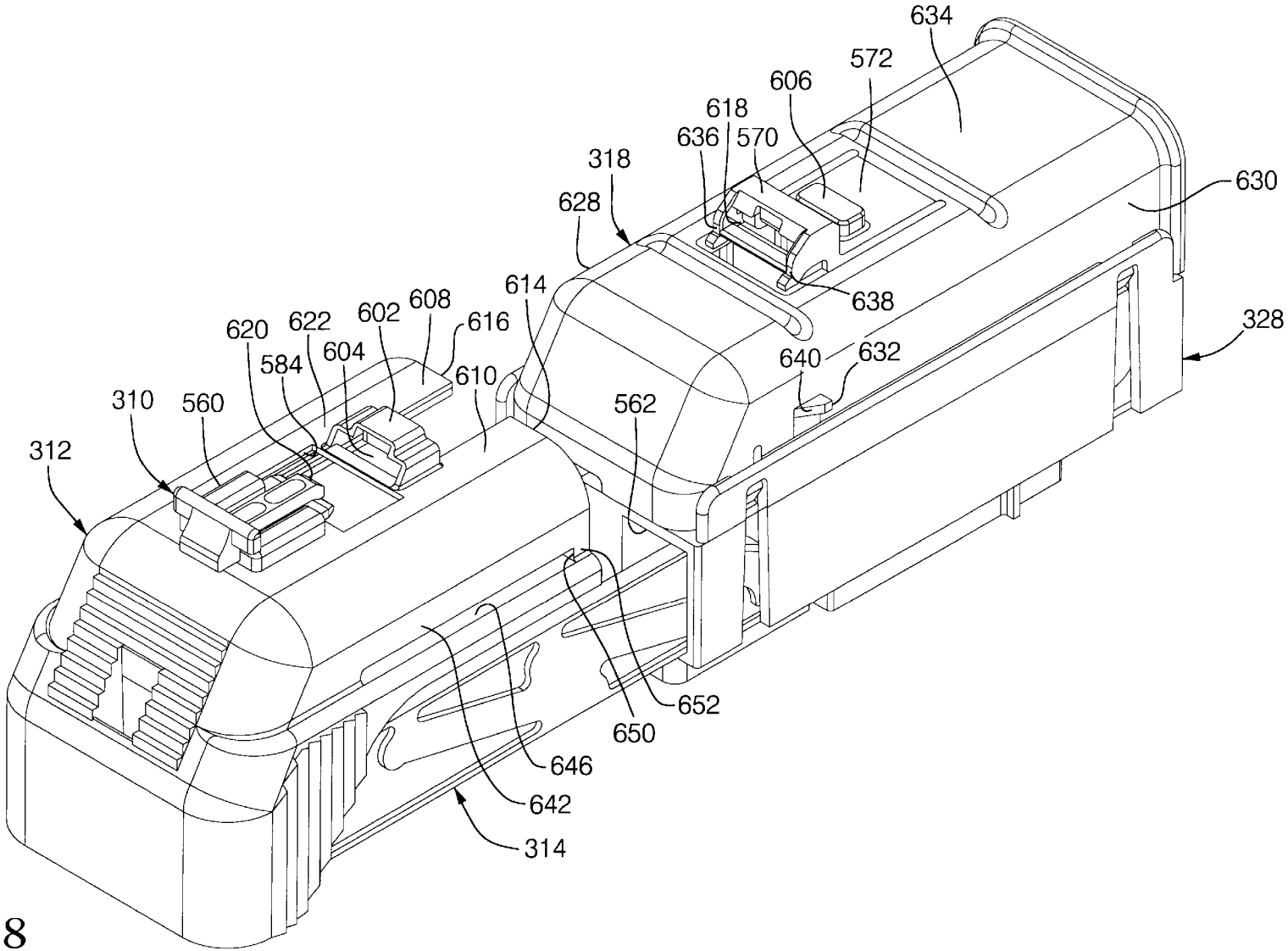
FIGS. 8 illustrates another example electrical connector according to this invention.
Figure 9:
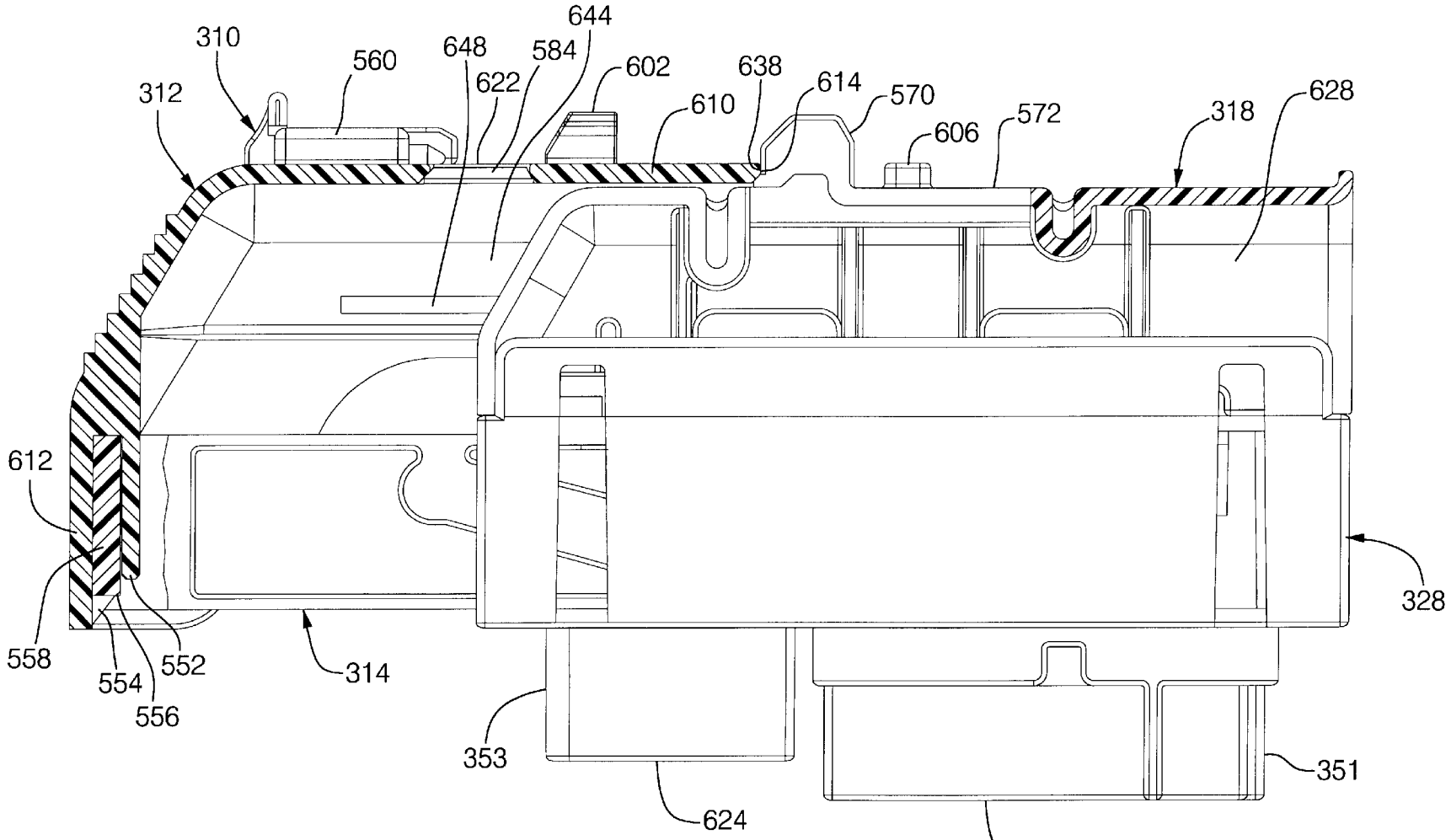
FIG. 9 illustrates a partial section view of the example electrical connector shown in FIG. 8 in a prestage state of the slide assist 12.
Figure 10:
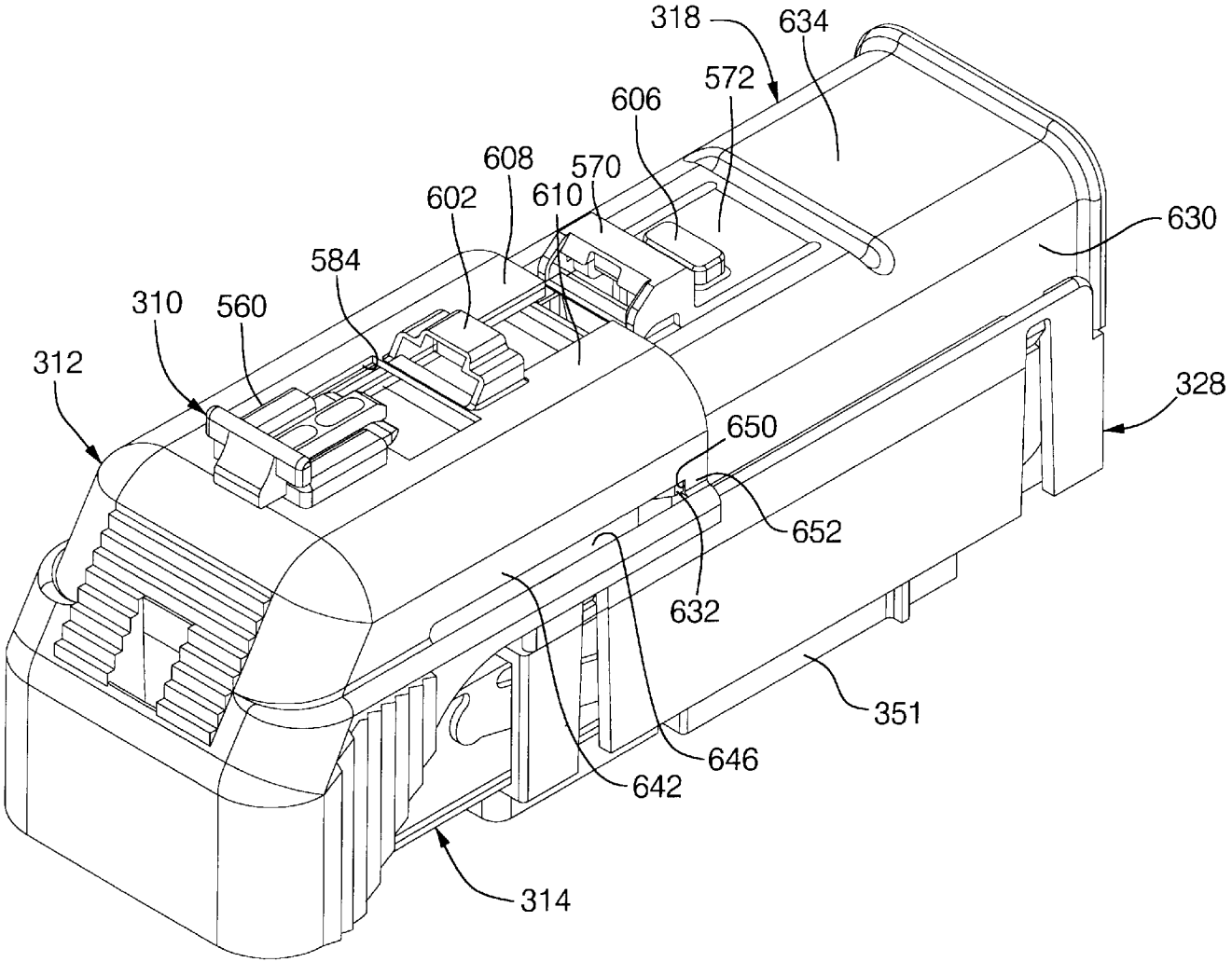
FIG. 10 illustrates a perspective view of the example electrical connector in the prestage state.

Referring now to FIGS. 8, 9 and 10, the example electrical connector shown has a preferred prestage engagement state illustrated in FIGS. 9 and 10. More particularly, the example connector includes outer housing 328, slide 314, slide assist 312 including CPA 310 and wire dress cover 318. The connector also includes the various internal components (not shown), including inner housings, a cable seal, a strain relief plate, comb locks, connector seals and terminals such as described above with reference to FIGS. 1–7. The outer housing 328 and wire dress cover 318 are together referred to as the housing assembly and the slide 314 and slide assist 312 are together referred to as the slide assembly.

The end 558 of slide 314 is located between tab 552 and end wall 612 of slide assist 312 and held in place by lock 554 seated in notch 556. The CPA 310 is snapped in place in intermediate holder 560 molded on the exterior of slide assist 312. When the slide assist 312 and slide 314 are engaged fully in place, the CPA lock feature 570 on cantilever finger 572 of wire dress cover 318 extends into opening 584 on slide assist 312 and tab 606, molded into the cantilever finger 572, extends into the portion of cavity 604 formed in the plane of upper surface 622 of slide assist 312 under assurance housing 602. Assurance housing 602 is molded into the upper surface 622 as shown. When the slide assist 312 and slide 314 are fully engaged to the outer housing 328, a manually applied force in the locking direction slides CPA 310 forward so that CPA 310 extends through cavity 618 in CPA lock feature 570 and so that end 620 of CPA 310 extends into the portion of cavity 604 furthest from upper surface 622. When the CPA 310 is so positioned, lock feature 570 is locked in opening 584 and the housing assembly and slide assembly are secured in the fully engaged state.

The wire dress cover 318 includes first and second side walls 628 and 630 extending perpendicular to and away from the top surface 634. Each side wall 628, 630 has a ramp lock 632 (only one shown) extending perpendicular to the respective side wall 628, 630 in a direction exterior of wire dress cover 318 with each ramp 640 (only one shown) of ramp locks 632 facing toward the slide assist 312.

The slide assist 312 has two side walls 642 (FIG. 8) and 644 (FIG. 9) perpendicular to and extending away from top surface 622. Each side wall 642 and 644 is positioned to slide over the outside of the corresponding side wall 630 and 628 of the wire dress cover when the slide assist 312 and wire dress cover 318 are engaged. Each side wall 642, 644 has an elongated slot 646, 648 aligned parallel to the direction of sliding engagement of the slide assist 312 and wire dress cover 318, which is also parallel to the plane of surface 622. The slots 646 and 648 are also positioned so that when slide 314 is inserted into the slot 562 and the other corresponding slot not shown in FIGS. 8–10 (similar to slots 262 and 264 in FIG. 1) in outer housing 328, slots 646 and 648 align, in the direction of sliding motion, with the ramp lock 632 and the other corresponding ramp lock (not shown) on side wall 628. Each slot 646, 648 has a locking wall 650 (only one shown) defining the end of the slot 646, 648 closest to the wire dress cover 318.

FIG. 8 shows that relative positions of slide assist 312 and slide 314 with respect to the outer housing 328 and wire dress cover 318 when the slide 314 is initially inserted into the outer housing 328. The state of the example connector shown in FIGS. 9 and 10 is referred to as the shipping prestage state having the slide 314 and slide assist 312 locked into the position shown with respect to the outer housing 328 and the wire dress cover 318. When an operator progresses the slide assist 312 and slide 314 from the position shown in FIG. 8 in an engagement direction to the position shown in FIGS. 9 and 10, the front ends 652 (only one shown) of side walls 642 and 644 must pass over the ramp locks 632. The shape of the slide assist 312 at the front ends 652 allows the side walls 642, 644 to be deflected by ramps 640 and pass over the ramp locks 632. Once the front ends 652 have passed over the ramp locks 632, the side walls return to their undeflected state and ramp locks 632 slide within the slots 646, 648 as shown in FIG. 10 with respect to slot 646. The end surfaces 614 and 616 of the first and second stop arms 608 and 610 of the slide assist 312 abut against the surfaces 638 and 636, respectively, of CPA lock feature 570 to act as a positive stop for engaging the slide assist 312 and slide 314 in the shipping prestage state. Locking wall 650 acts against lock 632 to prevent motion allowing slide assist 312 and slide 314 from disengaging from the shipping prestage state.

In the prestage state, the slide 314 has the slot inlets (not shown) similar to references 231, 233, 235 and 236 of FIG. 1 aligned with the slots (not shown) similar to slots 274 and 276 of FIG. 1 and two other corresponding slots in the outer housing 328 to receive the corresponding tabs such as tabs 204, 206, 210 and 212 of the male connector 200 in FIG. 5.

The positive stop formed by surfaces 638 and 636 of CPA lock feature 570 is releasable by manually deflecting cantilever finger 572 so that CPA lock feature 570 is out of the path of slide assist 312. Once CPA lock feature 570 is out of the path of slide assist 312, and a male connector (not shown in FIGS. 8–10) is aligned with the electrical connector, force applied to the slide assembly in the engagement direction moves the slide assembly past the prestage state into full engagement with the housing assembly and forces the male connector into full engagement with the electrical connector as described above with reference to FIG. 1–7.

In the even that an operator needs to disengage the slide assist 312 and slide 314 from the outer housing 328 and wire dress cover 318, the side walls 642 and 644 can be manually deflected outward to release the locking surfaces 650 from the ramp locks 632.

In the example shown in FIGS. 8, 9 and 10, the terminal position portions 351 and 353 of the outer housing 328 are of two different sizes, terminal position portion 351 being larger than portion 353 and adapted to hold more terminals than terminal position portion 353. Front faces 624 and 626 of the two terminal position portions 351 and 353 are located in different planes illustrating a shorter total overall length for the terminals within terminal position portion 351. One skilled in the art can easily adapt the inner housing and terminals to correspond to the shorter length of the terminal position portion 351. The different size and widths of the terminal position portions 351 and 353 illustrates the flexibility available from the electrical connector according to this invention, allowing one skilled in the art to vary the size and length of the terminal position portions of different connectors so that each connector has a unique configuration compared with other connectors that might be used in the same proximity within the vehicle. Adaptation of the necessary features of the mating male connectors to engage terminal position portions 351 and 353 is also within the level of one skilled in the art in view of the teachings herein.

We claim:

1. An electrical connector comprising:

a housing assembly (328, 318) having at least one first slot (562) extending substantially therethrough;

a releasable positive stop (636, 638) on the housing assembly;

at least one lock (632) on the housing assembly;

a slide assembly (312 and 314) slidably received within the at least one first slot; and at least one locking wall (650) on the slide assembly, wherein, in initial engagement of the slide assembly to the housing assembly where the slide assembly is slid into the at least one first slot in an engagement direction, the positive stop prevents movement of the slide assembly beyond a prestage state, wherein, in the prestage state, the lock engages the locking wall to prevent disengagement of the slide assembly from the prestage state, wherein, when the positive stop is released and a mating connector is aligned with the electrical connector, force applied to the slide assembly in the engagement direction moves the slide assembly past the prestage state to fully engage the housing assembly and to force the mating connector into full engagement with the electrical connector.

2. An electrical connector according to claim 1, wherein the housing assembly comprises an outer housing and a wire dress cover.

3. An electrical connector according to claim 2, wherein the at least one lock extends perpendicularly out of a first side wall of the wire dress cover and includes a ramp (640).

4. An electrical connector according to claim 3, also comprising:

a second side wall (642) on the slide assembly positioned to slide over the first side wall of the wire dress cover during engagement;

an elongated second slot (646) in the second side wall oriented parallel to the engagement direction, wherein the locking wall is located at an end of the elongated second slot, wherein during the initial engagement, a portion of the second side wall on the slide assembly is deflected by the ramp and slides over the lock, wherein when the prestage state is achieved, the second side wall returns to its undeflected state and the lock is positioned within the elongated second slot.

5. An electrical connector according to claim 1, wherein the positive stop comprises a lock feature (570) located on a cantilever finger (572) on the housing assembly.

6. An electrical connector according to claim 5, also comprising:

an opening (584) in a top surface of the slide assembly, wherein the positive stop is released by deflection of the cantilever finger, moving the lock feature out of the path of the slide assembly, wherein the housing assembly and slide assembly achieve a fully engaged state when the lock feature is capable of extending into the opening.

7. An electrical connector according to claim 6, wherein a CPA (10) is slidably located in an intermediate holder (560) in the slide assembly, wherein, when the housing assembly and slide assembly are in the fully engaged state with the lock feature extending into the opening, force applied to the CPA in a locking direction slides the CPA within the intermediate holder so that a portion of the CPA extends through the lock feature, locking the lock feature in the opening and securing the housing assembly and the slide assembly in the fully engaged state.

8. An electrical connector comprising:

a housing assembly (328 and 318) including an outer housing and a wire dress cover and having at least one first slot (562) extending substantially therethrough;

a releasable positive stop (636, 638) on the housing assembly;

at least one lock (632) on the housing assembly extending perpendicularly out of a first side wall of the wire dress cover and including a ramp;

a slide assembly (312 and 314) slidably received within the at least one first slot;

at least one locking wall (650) on the slide assembly;

second side wall on the slide assembly positioned to slide over the first side wall of the wire dress cover during an engagement of the housing assembly and the slide assembly;

an elongated second slot in the second side wall oriented parallel to an engagement direction, wherein the locking wall is located at an end of the elongated second slot, wherein, in initial engagement of the slide assembly to the housing assembly where the slide assembly is slid into the at least one first slot in the engagement direction, the positive stop prevents movement of the slide assembly beyond a prestage state, wherein, in the prestage state, the lock engages the locking wall to prevent disengagement of the slide assembly from the prestage state, wherein during the initial engagement, a portion of the second side wall on the slide assembly is deflected by the ramp and slides over the lock, wherein when the prestage state is achieved, the second side wall returns to its undeflected state and the lock is positioned within the elongated second slot, wherein, when the positive stop is released and a mating connector is aligned with the electrical connector, force applied to the slide assembly in the engagement direction moves the slide assembly past the prestage state to fully engage the housing assembly and to force the mating connector into full engagement with the electrical connector.

* * * * *